US011236643B2

(12) United States Patent
Andrisani et al.

(10) Patent No.: US 11,236,643 B2
(45) Date of Patent: Feb. 1, 2022

(54) ACTUATION APPARATUS

(71) Applicant: Eaton Intelligent Power Limited, Dublin (IE)

(72) Inventors: Nicola Andrisani, Cumiana (IT); Jan Kindermann, Prague (CZ); Mirko Guaschino, Casale Monferrato (IT); Yuriy Mysak, Turin (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/978,210

(22) PCT Filed: Mar. 6, 2019

(86) PCT No.: PCT/EP2019/055590
§ 371 (c)(1),
(2) Date: Sep. 4, 2020

(87) PCT Pub. No.: WO2019/170760
PCT Pub. Date: Sep. 12, 2019

(65) Prior Publication Data

US 2021/0040869 A1 Feb. 11, 2021

(30) Foreign Application Priority Data

Mar. 6, 2018 (GB) ..... 1803581

(51) Int. Cl.
*F01L 1/18* (2006.01)
*F01L 13/00* (2006.01)

(52) U.S. Cl.
CPC ..... *F01L 1/18* (2013.01); *F01L 13/0005* (2013.01); *F01L 2001/186* (2013.01)

(58) Field of Classification Search
CPC .... F01L 1/18; F01L 13/0005; F01L 2001/186
See application file for complete search history.

(56) References Cited

U.S. PATENT DOCUMENTS

| | | | | |
|---|---|---|---|---|
| 5,653,198 | A * | 8/1997 | Diggs | F01L 1/185 123/90.16 |
| 10,550,739 | B2 | 2/2020 | Raimondi | |
| 2003/0111031 | A1 | 6/2003 | Hendriksma et al. | |

FOREIGN PATENT DOCUMENTS

| | | | |
|---|---|---|---|
| CN | 106414918 | A | 2/2017 |
| DE | 102007033821 | A1 | 1/2009 |
| EP | 2157292 | A1 | 2/2010 |

(Continued)

*Primary Examiner* — Zelalem Eshete
(74) *Attorney, Agent, or Firm* — Mei & Mark, LLP

(57) ABSTRACT

An actuation apparatus for actuating a component of a switchable valve train device of an internal combustion engine including: a shaft; an actuation lever mounted on the shaft for pivotal motion of the actuation lever between a first position for actuation of the component and a second position for de-actuation of the component; and a biasing means for urging the actuation lever from the second position towards the first position. In use, the biasing means is biased when an actuation source attempts to cause the actuation lever to be in the first position when the component is non-actuatable, such that the biasing means causes the actuation lever to pivot from the second position to the first position, thereby to actuate the component when the component becomes actuatable again.

17 Claims, 3 Drawing Sheets

(56) References Cited

FOREIGN PATENT DOCUMENTS

| | | | |
|---|---|---|---|
| GB | 2309489 | A | 7/1997 |
| WO | WO 2013156610 | A1 | 10/2013 |
| WO | WO 2017144706 | A1 | 8/2017 |
| WO | WO 2017202845 | A1 | 11/2017 |

* cited by examiner

ACTUATION APPARATUS

CROSS-REFERENCE TO PRIOR APPLICATIONS

This application is a U.S. National Phase application under 35 U.S.C. § 371 of International Application No. PCT/EP2019/055590, filed on Mar. 6, 2019, and claims benefit to British Patent Application No. GB 1803581.6, filed on Mar. 6, 2018. The International Application was published in English on Sep. 12, 2019 as WO 2019/170760 under PCT Article 21(2).

FIELD

The present invention relates to actuation, and more specifically actuation of components of switchable valve train devices of an internal combustion engine.

BACKGROUND

Internal combustion engines may comprise switchable engine or valve train devices. For example, valve train assemblies may comprise a switchable rocker arm (also referred to as a switchable finger follower) to provide for control of valve actuation by alternating between at least two or more modes of operation (e.g. valve-lift modes). Such rocker arms typically involve multiple bodies, such as an inner arm and an outer arm. These bodies are latched together to provide one mode of operation (e.g. a first valve-lift mode) and are unlatched, and hence can pivot with respect to each other, to provide a second mode of operation (e.g. a second valve-lift mode). Typically, a moveable latch pin is used and actuated and de-actuated to switch between the two modes of operation.

WO 2013/156610 A1 [EATON SRL] discloses such a switchable rocker arm with a moveable latch pin. The default position of the latch pin is unlatched, and it is retained in this position using biasing means. When required, the latch pin is actuated to the latched position using an external actuation mechanism based on a leaf spring. When actuation is required, the leaf spring is controlled to rotate a certain amount so as to engage with a roller of the latch pin, and hence push the latch pin into the latched position. In this way, the mode of operation that the switchable rocker arm provided for is controlled, for example, to provide for internal Exhaust Gas Recirculation.

Implementation of actuation of switchable rocker arms can be difficult due to the tight packaging constraints associated with internal combustion engines.

SUMMARY

In an embodiment, the present invention provide an actuation apparatus for actuating a component of a switchable valve train device of an internal combustion engine, the actuation apparatus comprising: a shaft; an actuation lever mounted on the shaft for pivotal motion of the actuation lever between a first position for actuation of the component and a second position for de-actuation of the component; and a biasing means configured to urge the actuation lever from the second position towards the first position, wherein the apparatus is configured such that, in use, the biasing means is biased when an actuation source attempts to cause the actuation lever to be in the first position when the component is non-actuatable, such that the biasing means causes the actuation lever to pivot from the second position to the first position, thereby to actuate the component when the component becomes actuatable again.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

In an embodiment, the present invention provides an actuation apparatus as described herein.

In an embodiment, the present invention provides a valve train assembly as described herein.

Further features and advantages of the invention will become apparent from the following description of examples of the invention which is made with reference to the accompanying drawings.

Figure 1:
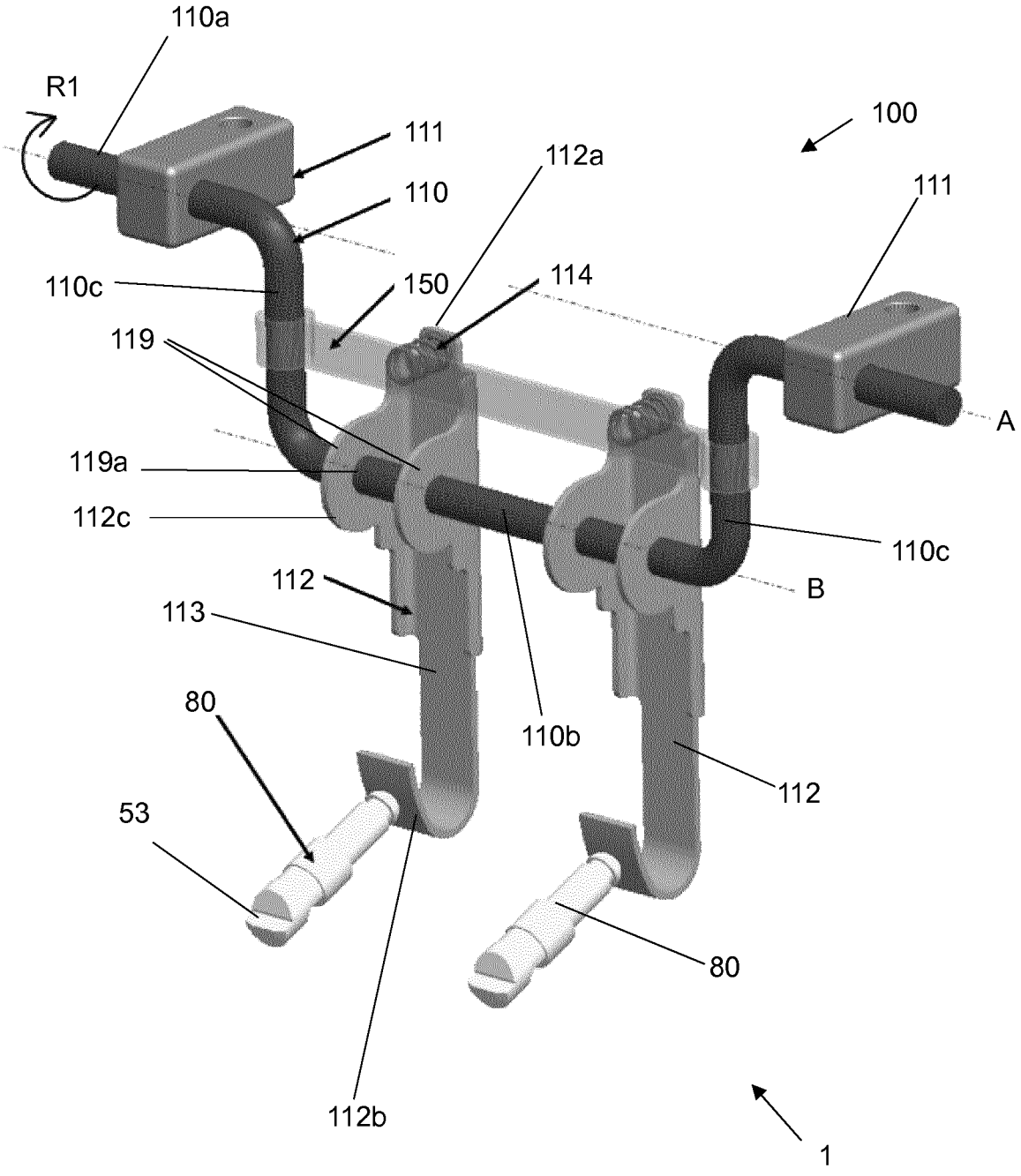
FIG. 1 illustrates schematically a perspective view of a valve train assembly according to a first example.
Figure 2:
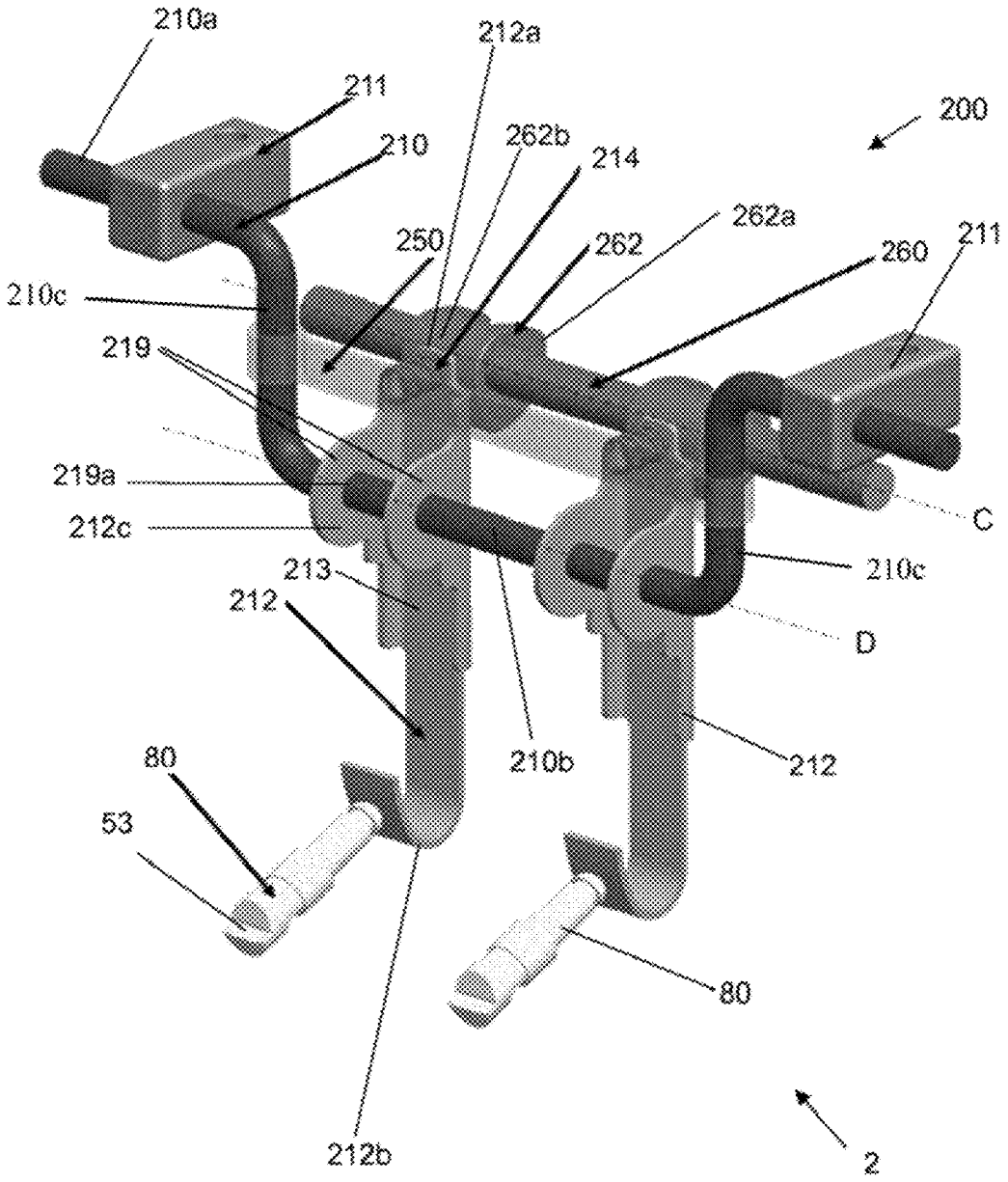
FIG. 2 illustrates schematically a perspective view of a valve train assembly according to a second example.
Figure 3:
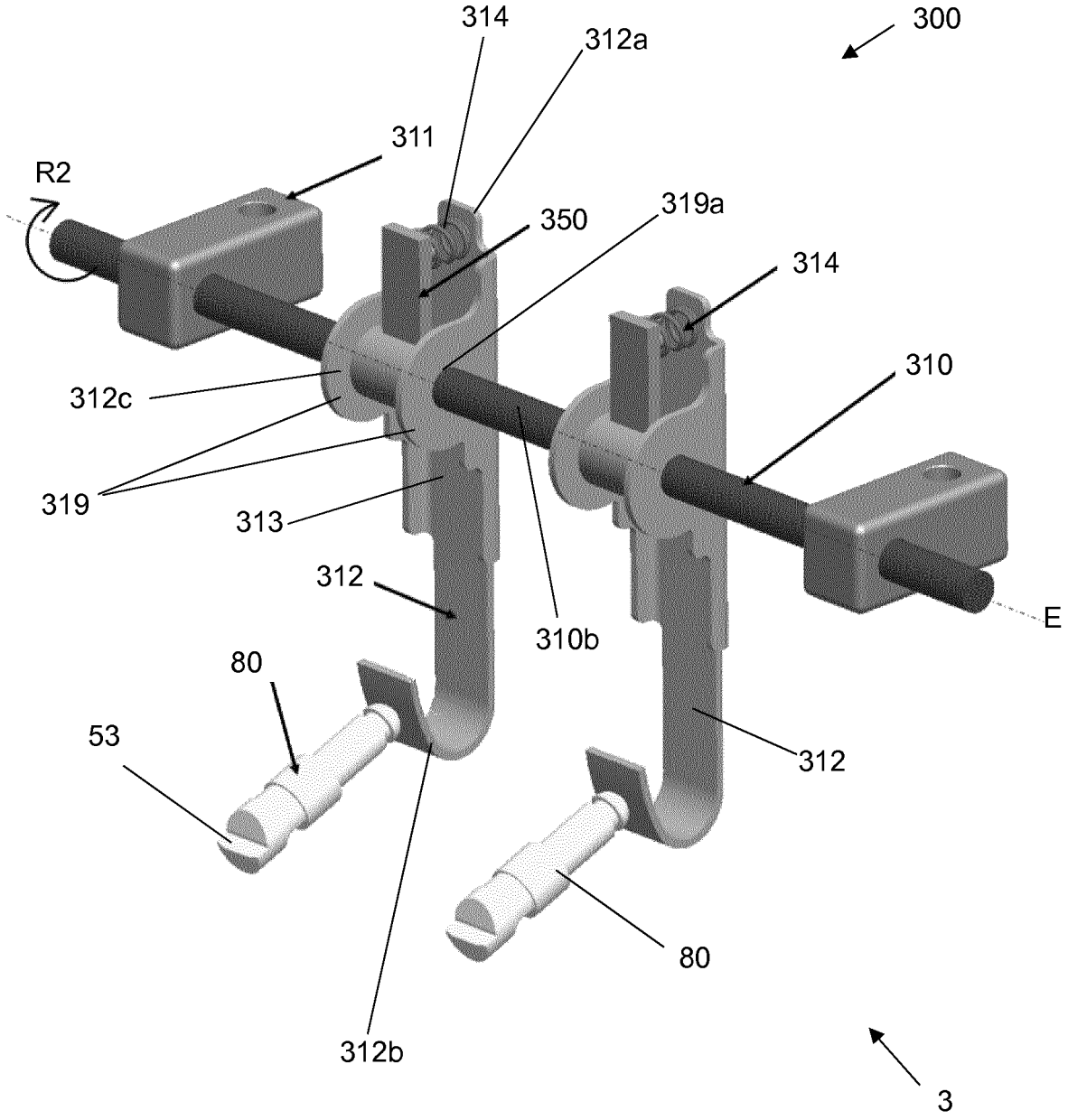
FIG. 3 illustrates schematically a perspective view of a valve train assembly according to a third example.

FIGS. 1 to 3 illustrate a valve train assembly 1, 2, 3 according first to third examples, respectively. Each example valve train 1, 2, 3, is a valve train assembly of an internal combustion engine. Each example valve train assembly 1, 2, 3 comprises an actuation apparatus 100, 200, 300. Each actuation apparatus 100, 200, 300 is arranged to actuate a component of a switchable valve train device of the valve train assembly 1, 2, 3. In each of these examples, the switchable valve train device is a switchable rocker arm, and the component of the switchable rocker arm is a moveable latching arrangement of the rocker arm.

The switchable rocker arm is arranged to control opening and closing of a valve, for example an exhaust valve, of a cylinder of an overall internal combustion engine. The latching arrangement comprises a moveable latch pin 80 for latching an inner body and an outer body of the rocker arm together.

It should be noted that for each illustrated example valve train assembly 1, 2, 3 there is illustrated two latch pins 80, one for each of two rocker arms of the valve train assembly 1, 2, 3. For example, in each example, the two rocker arms may be for controlling opening and closing of a respective two valves, for example a respective two exhaust valves, that are associated with a common cylinder of the internal combustion engine. In each of the illustrated example valve train assemblies 1, 2, 3 the actuation apparatus 100, 200, 300 may actuate the two latching arrangements (i.e. cause the two latch pins 80 to move) similarly and in common. For ease of explanation therefore, the following description is given with respect to actuation of a latching arrangement of one of the two rocker arms, but it will be appreciated that in some examples the latching arrangements of more than one rocker arms may be actuated in substantially the same way.

Switchable rocker arms having moveable latch pins are known per se, see e.g. WO 2013/156610 A1 [EATON]. The switchable rocker arm may comprise an inner body and an outer body. The inner body and the outer body may be latched together by the moveable latch pin 80 to provide a one mode of operation (e.g. one valve-lift mode) and unlatched, and hence can pivot with respect to each other, to provide a different mode of operation (e.g. a different valve-lift mode).

The latch pin 80 may be slidably received in a bore of the outer body of the rocker arm. The latch pin 80 defines a contact surface 53 for engaging with a corresponding surface of the inner body for latching the inner body and the outer body together.

The latch pin 80 may be moveable between a first position in which the outer body and the inner body are un-latched and hence can pivot with respect to each other about a pivot axis so that the rocker arm may provide for a first mode of operation, and a latched position in which the outer body and the inner body are latched together and hence can move or pivot (e.g. about a hydraulic lash adjuster, HLA) as a single body so that the rocker arm may provide for a second mode of operation. For example, when the inner body and the outer body are unlatched and a lobe of a lift cam engages a roller follower of the inner body, the inner body may pivot relative to the outer body against the return spring arrangement so as to absorb as "lost motion" the lobe of the lift cam and hence no valve event may occur, whereas when the inner body and the outer body are latched together the lobe of the lift cam engaging the roller follower of the inner body may cause the inner body and outer body to pivot as a single body, which may in turn may cause a valve event to occur. The rocker arm may comprise a return spring arrangement for returning the inner body to its rest position after it is has pivoted with respect to the outer body.

The latching arrangement may comprise a biasing element that urges the latch pin 80 to the unlatched position.

It will be appreciated that in some examples, the rocker arm may be any rocker arm comprising a plurality of bodies that move relative to one another, and which are latched together to provide one mode of operation (valve-lift mode) and are unlatched, and hence can move with respect to each other, to provide a second mode of operation (valve-lift mode). For example, the rocker arm may configured for internal Exhaust Gas Recirculation (iEGR), Cylinder Deactivation (CDA), Early Exhaust Valve Opening (EEVO), or the like applications.

Referring now to FIG. 1, the valve train assembly 1 according to the first example comprises an actuation apparatus 100 for actuating the latching arrangements (each comprising the moveable latch pin 80) of a switchable rocker arm. For example, actuation of the latching arrangement may be controlled when it is desired to change the mode of operation of the rocker arm, for example as described above.

The actuation apparatus 100 comprises a shaft 110, an actuation lever 112 mounted to the shaft 110 for pivotal movement relative to the shaft 110, and a biasing means 114 (also referred to herein as a compliance spring 114). It is noted again that two actuation levers 112 and two associated biasing means 114 are illustrated in FIG. 1, but as described above, for each of explanation, only one will be referred to as they operate similarly and in common.

The actuation apparatus 100 also comprises an actuation source, for example an electrical motor or hydraulic motor or other suitable means, arranged to rotate the shaft 110 (see e.g. arrow R1). The actuation apparatus 100 also comprises a support 111 (two are shown in FIG. 1) arranged to support the shaft 110. The supports may be fixed to a portion of the internal combustion engine. For example, the supports 111 may be fixed to a cylinder head or a cylinder head cover of the internal combustion engine.

In overview, and as described in more detail below, the actuation lever 112 is pivotable between a first position for actuation of the latching arrangement and a second position for de-actuation of the latching arrangement. The actuation apparatus 100 is arranged such that, in use, the biasing means 114 is biased when the actuation source attempts to cause the actuation lever 112 to be in the first position when the latching arrangement is non-actuatable, such that the biasing means 114 causes the actuation lever 112 to pivot from the second position to the first position, thereby to actuate the latching arrangement, when the latching arrangement becomes actuatable again.

Specifically, in this example, the shaft 110 is a crankshaft 110. The shaft 110 comprises a first portion 110*a* defining a first axis A, and a second portion 110*b* defining a second axis B. The second axis B is substantially parallel with and radially offset from the first axis A. The actuation lever 112 is mounted to the second portion 110*b* of the shaft 110. The first portion 110*a* of the shaft 110 is rotatable (see e.g. arrow R1) about the first axis A by the actuation source to cause the second portion 110*b* of the shaft 110 to move along an arc, i.e. a substantially circular arc. As illustrated, and in use, the second portion 110*b* is closer to the latching arrangements (comprising the latch pin 80) than is the first portion 110*a* of the shaft 110. The supports 111 are arranged to support the first portion 110*a* of the shaft 110. The first portion 110*a* and the second portion 110*b* of the shaft 110 are connected by joining portions 110*c* of the shaft that extend radially out from the first portion 110*a* so as to connect to the second portion 110*b* of the shaft 110.

The actuation lever 112 is generally elongate. The actuation lever 112 is mounted on the shaft 110 (specifically the second portion 110*b* of the shaft 110) for pivotal motion of the actuation lever 112 between a first position for actuation of the latching arrangement (i.e. for movement of the latch pin 80 to a position in which it latch the first and second bodies of the rocker arm together) a second position for de-actuation of the latching arrangement (i.e. for movement of the latch pin 80 to a position in which the first and second bodies of the rocker arm are unlatched).

The actuation lever 112 is pivotally mounted to the shaft 110 (specifically the second portion of the shaft 110*b*) at or towards a central portion 112*c* of the actuation lever 112. The shaft 110 is generally circular in cross section. The central portion 112*c* of the actuation lever 112*c* comprises two wings 119 extending perpendicularly from either side of a main length 113 of the actuation lever 112. Each wing 119 defines an aperture 119*a* through which the shaft 110 (specifically the second portion 110*b* of the shaft 110) is received.

The biasing means 114 is arranged to urge or preload the actuation lever 112 from the second position towards the first position. The biasing means 114 is a coil spring 114. A first end of the biasing means 114 contacts a reaction member 150 fixed relative to the shaft 110. The reaction member 150 is formed as a bridge that spans across the two joining portions 110*c* of the shaft. A second end of the biasing means contacts the actuation lever 112 at a first end portion 112*a* of the actuation lever 112. The biasing means 114 therefore biases the first end portion 112*a* of the actuation lever 112 away from the reaction member 150, thereby urging rotation of the actuation lever 112 towards the first position. In other words, the biasing means 114 is arranged to react against the reaction member 150 so that the biasing means urges the actuation lever 112 towards the first position. A second end portion 112*b* of the actuation lever 112, located on an opposite side of the central portion 112*c* to the first end portion 112*a* of the actuation lever 112, is arranged for contacting the latching arrangement (i.e. for contacting the latch pin 80) of the rocker arm. The second end portion 112*c* is hooked in shape and defines a curved surface for contacting the latching arrangement. This may reduce wear and/or may ensure that the actuation lever 112 can apply a suitable actuation force to the latching arrangement at any point in the engine cycle.

The actuation source may be controlled by a control unit. When actuation of the latching arrangement is required (for example when a mode of operation of the rocker arm is required to be changed) the actuation source may rotate the first portion 110*a* of the shaft 110 (see arrow R1), which causes the second portion 110*b* of the shaft 110 to travel along an arc towards the latching arrangement, which in turn causes the actuation lever 112 to exert a force onto the latching arrangement.

In cases where the latching arrangement is actuatable (i.e. the latch pin 80 is free to be moved from the unlatched position to the latched position), this force may cause actuation of the latching arrangement (i.e. may cause the latch pin 80 to move from the unlatched position to the latched position). Hence the mode of operation of the rocker arm may be changed, substantially immediately.

However, in some cases, the latching arrangement may not be actuatable (i.e. non-actuatable), e.g. the latch pin 80 may not be free to move, e.g. may be blocked. For example, the actuation of the latch pin 80 may not be possible immediately due to an engine condition. For example, a lift profile of a lift cam may be engaged with the roller follower of the inner body of the rocker arm. In this case, the inner body will be rotated with respect to the outer body, hence blocking the path of the latch pin 80 from moving from the unlatched position to the latched position.

In these cases, (i.e. when the latching arrangement is non-actuatable) when the actuation source rotates the first portion 110*a* of the shaft 110 in order to attempt to actuate the latching arrangement, the actuation lever 112 is forced (by the latch pin 80 pushing on the second end portion 112*b* of the actuation lever) to pivot about the second portion 110*b* of the shaft 110 from the first portion to the second position, which in turn biases (e.g. compresses, energises) the biasing means 114. As soon as (i.e. the instant that) the latching arrangement becomes actuatable again, i.e. as soon as latch pin 80 becomes free to move again (i.e. becomes unblocked, e.g. as soon as the roller follower of the inner body is engaged with a base circle of the lift cam and hence the inner body is no longer blocking the path of the latch pin 80), the energy stored in the biasing of the biasing means 114 will cause the actuation lever to pivot from the second position to the first position, thereby actuating the latching arrangement. The biasing means 114 is stronger than the biasing element of the latching arrangement of the rocker arm, and hence the biasing means 114 can pivot the actuation lever 112 from the second position to the first portion against the force of the biasing element.

In other words, the biasing means 114 is biased when the actuation source attempts to cause the actuation lever 112 to be in the first position (i.e. when the actuation source rotates the first portion 110*a* of the shaft 110 in order to attempt to actuate the latching arrangement) when the latching arrangement is non-actuatable, such that the biasing means 114 causes the actuation lever 112 to pivot from the second position to the first position thereby to actuate the latching arrangement when the component becomes actuatable again.

As a result, the latch pin 80 is moved from the unlatched position to the latched position, hence latching the inner body and the outer body together, hence switching mode of operation of the rocker arm.

As a result, regardless of the blocked or unblocked state of the latch pin 80 (i.e. regardless of whether the latching arrangement is actuatable or non-actuatable), the latching arrangement may be actuated by the actuation apparatus 100 as soon as it is physically possible to do so, i.e. as soon as the rocker arm is not in a state which blocks actuation. This may be referred to as a compliance function of the actuation apparatus 100. This reduces the need to control the timing of the actuation to be synchronised with the engine cycle, and hence may provide for simpler and more efficient control.

At a later stage, for example when de-actuation of the latching arrangement is required, the actuation source may rotate the first portion 110*a* of the shaft 110 in an opposite direction (i.e. opposite to the direction illustrated by the arrow R1 in FIG. 1) so that the second portion 110*b* of the shaft 110 and hence the actuation lever 112 move away from the latching arrangement. As a result, the second end 112*b* of the actuation lever 112 no longer exerts a substantial force to the latch pin 80. As a result, the latch pin 80 may move from the latched position to the unlatched position under the force of the biasing element, hence the latch pin 80 no longer latches the inner body and the outer body together, and hence the operation mode of the rocker arm is switched back again.

Having a compliance functionality provided by the biasing means 114 acting on the actuation lever 112 may provide for improved packaging for example as compared to providing the compliance functionality in the actuation arrangements of the rocker arms themselves. For example, not having to provide compliance functionality in the rocker arms themselves allows for the packaging footprint of the rocker arms to be reduced.

Having a biasing means 114 that is a spring 114, for example a compression 114, may allow for the compliance functionality to be provided without using a torsional spring, which may be advantageous in some cases.

Having the actuation lever 112 mounted to a second portion 110*b* of the shaft 110 that is radially offset from the first portion 110*a* of the shaft 110*a* allows for the actuation lever 112 to remain close to the latching arrangement even when there is a need to locate the shaft and/or the actuation source relatively far from the latching arrangements (for example on a top of the cylinder head of the internal combustion engine), for example due to packaging constraints of the internal combustion engine. This may allow for improved packaging flexibility. Having the actuation lever 112 relatively close to the latching arrangement allows for the length of the actuation lever 112 to remain relatively short. This may allow for reduced production costs for example because a shorter length of actuation lever material may be used to manufacture the actuation lever 112 and/or because thinner actuation lever material may be used as the torque the actuation lever experiences during use may remain relatively low. Further, having the actuation lever 112 relatively close to the latching arrangement so that the length of the actuation lever 112 may remain relatively short may also allow for the force and/or torque that the compliance spring 114 is required to produce and or withstand during use may be relatively small, which in turn may reduce the costs associated therewith and/or may improve reliability.

Having the support 111 that supports the shaft 110 supporting the first portion of the shaft 110 that is radially distal from the second portion of the shaft 110 on which the actuation lever 112 is mounted may allow for the actuation apparatus 100 to be supported and or fixed to a portion of the internal combustion engine (e.g. cylinder head cover and/or a top portion of a cylinder head) that may allow for improved packaging of the actuation apparatus 100 into the engine.

Referring now to FIG. 2, there is illustrated a valve train assembly 2 according to a second example. The second example valve train assembly 2 comprises one or more rocker arms (two are implied by the two latch pins 80 shown in FIG. 2), and an actuation apparatus 200 for actuating a latching arrangement of each of the switchable rocker arms.

Each switchable rocker arm, including the latching arrangement comprising the latch pin 80, may be the same as the rocker arm described above in the first example valve train assembly, and for brevity will not be described again.

The actuation apparatus 200 of this second example is similar to the actuation apparatus 100 of the first example described above with reference to FIG. 1. For brevity, features of this second example actuation apparatus 200 that are the same or similar to features of the first example actuation apparatus 100 will not be described again in detail again and are given the same reference numerals as for the first example except increased by 100.

The main differences are that in the first example actuation apparatus 100, the actuation source causes the shaft 110 (specifically the first portion 110*a* of the shaft 110) of the actuation apparatus 100 to rotate within the support 111 so as to attempt to cause actuation of the latching arrangement of the rocker arm, whereas in the second example actuation apparatus, the shaft 210 is fixed relative to the support 211, and instead the actuation source rotates a further shaft 260 having a lobed cam 262 mounted thereon in order to attempt to cause actuation of the latching arrangement of the rocker arm.

More specifically, referring to FIG. 2, the actuation apparatus 200 comprises a shaft 210, an actuation lever 212 mounted to the shaft 210, and a biasing means 214 (also referred to herein as a compliance spring 214). It is noted again that two actuation levers 212 and two associated biasing means 214 are illustrated in FIG. 2, but as described above, for ease of explanation, only one will be described in detail as they may operate (are operated) similarly and in common.

The shaft 210 comprises a first portion 210*a* defining a first axis, and a second portion 210*b* defining a second axis D. The second axis D is substantially parallel with and radially offset from the first axis. The actuation lever 212 is mounted to the second portion 210*b* of the shaft 210, and is arranged to pivot about the second axis D.

The actuation apparatus 200 comprises a support 211 (two are shown in FIG. 2) arranged to support the shaft 210. The shaft 210 (specifically the first portion 210*a* of the shaft 210) is fixed relative to the support 211, i.e. is configured not to rotate within the support 211. As illustrated, and in use, the second portion 210*b* is closer to the latching arrangements (comprising the latch pin 80) than is the first portion 210*a* of the shaft 210. The first portion 210*a* and the second portion 210*b* of the shaft 210 are connected by joining portions 210*c* of the shaft that extend radially out from the first portion 210*a* so as to connect to the second portion 210*b* of the shaft 210.

The actuation lever 212 may be the same as the actuation lever 112 described above in the first example. The actuation lever 212 is mounted on the shaft 210 (specifically the second portion 210*b* of the shaft 210) for pivotal motion of the actuation lever 212 between a first position for actuation of the latching arrangement (i.e. for movement of the latch pin 80 to a position in which it latches the first and second bodies of the rocker arm together) a second position for de-actuation of the latching arrangement (i.e. for movement of the latch pin 80 to a position in which the first and second bodies of the rocker arm are unlatched).

The actuation lever 212 comprises a central portion 212*c* comprising two wings 219 extending from a main length 213 of the actuation lever 212. Each wing 219 defines an aperture 219*a* through which the second portion 210*b* of the shaft 210 is received. The biasing means 214 is arranged to urge or preload the actuation lever 212 from the second position towards the first position. A first end of the biasing means 214 contacts a reaction member 250 fixed relative to the shaft 210. The reaction member 250 is formed as a bridge that spans across the two joining portions 210*c* of the shaft. A second end of the biasing means contacts the actuation lever 212 at a first end portion 212*a* of the actuation lever 212. A second end portion 212*b* of the actuation lever 112, located on an opposite side of the central portion 212*c* to the first end portion 212*a* of the actuation lever 212, is arranged for contacting the latching arrangement (i.e. for contacting the latch pin 80) of the rocker arm.

The actuation apparatus 200 comprises a further shaft 260 that has mounted thereon a lobed cam 262 (two lobed cams 262 are shown in FIG. 2, one for each of the actuation levers 212). The lobed cam 262 has a lobed profile 262*a* and a base circle 262*b*. The further shaft 260 and the lobed cam 262 are located on an opposite side of the actuation lever 212 to the latching arrangement and are aligned with the first end portion 212*a* of the actuation lever 212.

The actuation apparatus 200 comprises an actuation source, for example an electrical motor or hydraulic motor or other suitable means, arranged to rotate the further shaft 210. The actuation source may be controlled by a control unit.

In an initial state, the further shaft 260 may be orientated such that the lobed profile 262*b* of the lobed cam 262 contacts or pushes the first end portion 212*a* of the actuation lever 212 towards the reaction member 250. In this state, the actuation lever 212 is in the second position, and the biasing means 214 is biased (compressed, energised). In this state, the second end portion 212*b* of the actuation lever 212 applies substantially no force to the latching arrangement (specifically the latch pin 80), and hence the latch pin 80 may be in its default, unlatched, position, and the rocker arm may therefore be configured to provide a given mode of operation.

When actuation of the latching arrangement is required (for example when a mode of operation of the rocker arm is required to be changed) the actuation source may rotate the further shaft 260 so that a base circle 262*b* of the lobed cam 262 contacts or is orientated towards the actuation lever 212 (specifically the first end portion 212*a* of the actuation lever 212). The first end portion 212*a* of the actuation lever 212 now has space to move towards the lobed cam 262. The energised biasing means 214 applies a force to the first end portion 212*a* of the actuation lever 212 that urges the actuation lever towards the first portion.

In cases where the latching arrangement is actuatable (i.e. the latch pin 80 is free to be moved from the unlatched position to the latched position), the biasing means 214 may cause the actuation lever 212 to pivot from the second position to the first position, thereby to actuate the latching arrangement of the rocker arm (i.e. cause the latch pin 80 to move to a position in which it latches the first and second bodies of the rocker arm together). Hence the mode of operation of the rocker arm may be changed, substantially immediately.

However, as described above in the first example, in some cases, the latching arrangement may not be actuatable (i.e. non-actuatable), e.g. the latch pin 80 may not be free to move, e.g. may be blocked.

In these cases, (i.e. when the latching arrangement is non-actuatable) when the actuation source rotates the further shaft 260 so that the base circle 262*b* of the lobed cam contacts or is orientated towards the actuation lever 212, the biasing means 214 may not cause the actuation lever 212 to pivot to the first position immediately, but rather cause the actuation lever 212 to pivot from the second position to the first position, thereby to actuate the component of the switchable valve train device, when the latching arrangement becomes actuatable again.

In other words, the biasing means 214 is biased when the actuation source attempts to cause the actuation lever 212 to be in the first position (i.e. when the actuation source rotates the further shaft 260 so that the base circle 262*b* of the lobed cam contacts or is orientated towards the actuation lever 212) when the latching arrangement is non-actuatable, such that the biasing means 214 causes the actuation lever 212 to pivot from the second position to the first position thereby to actuate the latching arrangement when the latching arrangement becomes actuatable again.

As a result, the latch pin 80 is moved from the unlatched position to the latched position, hence latching the inner body and the outer body together, hence switching mode of operation of the rocker arm, as soon as it is possible to do so. This may be referred to as a compliance function of the actuation apparatus 200. This reduces the need to control the timing of the actuation to be synchronised with the engine cycle, and hence may provide for simpler and more efficient control.

At a later stage, for example when de-actuation of the latching arrangement is required, the actuation source may rotate the further shaft 260 so that the lobed profile 262*a* of the lobed cam 262 again contacts or pushes the first end portion 212*a* of the actuation lever 212 towards the reaction member 250, which causes the actuation lever 212 to pivot from the second position to the first position, which causes the biasing means 214 to be biased (compressed, energised) again. The second end portion 212*b* of the actuation lever 212 therefore again applies substantially no force to the latching arrangement (specifically the latch pin 80), and hence the latch pin 80 may move again to its default, unlatched, position, and hence the operation mode of the rocker arm is switched back again.

Similarly to as described above for the first example, having a compliance functionality provided by the biasing means 214 may provide for improved packaging; having the actuation lever 212 mounted to a second portion 210*b* of the shaft 210 may allow for improved packaging flexibility as well as for reduced production costs and/or reliability of the actuation lever 212 and/or the compliance spring 214; and having the support 211 that supports the shaft 210 supporting the first portion of the shaft 210 may allow for improved packaging of the actuation apparatus 200 into the engine.

Referring now to FIG. 3, there is illustrated a valve train assembly 3 according to a third example. The third example valve train assembly 3 comprises one or more rocker arms (two are implied by the two latch pins 80 shown in FIG. 3), and an actuation apparatus 300 for actuating a latching arrangement of each of the switchable rocker arms.

Each switchable rocker arm, including the latching arrangement comprising the latch pin 80, may be the same as the rocker arm described above in the first example valve train assembly 1, and for brevity will not be described again.

The actuation apparatus 300 of this third example is similar to the actuation apparatus 100 of the first example described above with reference to FIG. 1. For brevity, features of this third example actuation apparatus 300 that are the same or similar to features of the first example actuation apparatus 100 will not be described again in detail and are given the same reference numerals as for the first example except increased by 200.

The main differences are that in the first example actuation apparatus 100, the shaft 110 has a first 110*a* and second 110*b* portion radially offset from one another and the reaction member 150 spans across the two connecting portions 110*c* of the shaft 110, whereas in the third example actuation apparatus 300, the shaft 310 has substantially only one longitudinal axis E and the reaction member 350 extends radially from the shaft 310 such that when the actuation source rotates the shaft 310, the reaction member 350 rotates with the shaft about the axis E.

More specifically, referring to FIG. 3, the actuation apparatus 300 comprises a shaft 310, an actuation lever 312 mounted to the shaft 310, and a biasing means 314 (also referred to herein as a compliance spring 314). It is noted again that two actuation levers 312 and two associated biasing means 314 are illustrated in FIG. 3, but as described above, for ease of explanation, only one will be referred to as they operate (are operated) similarly and in common.

The shaft 310 (i.e. the entire length or substantially the entire length of the shaft 310) extends along a longitudinal axis E. A support 311 (two are shown in FIG. 3) supports the shaft 310. The shaft 310 is rotatable in the support 311 about the axis E.

The actuation lever 312 may be the same as the actuation lever 112 described above in the first example. The actuation lever 312 is mounted on the shaft 310 (specifically the second portion 310*b* of the shaft 310) for pivotal motion of the actuation lever 312 between a first position for actuation of the latching arrangement (i.e. for movement of the latch pin 80 to a position in which it latches the first and second bodies of the rocker arm together) and a second position for de-actuation of the latching arrangement (i.e. for movement of the latch pin 80 to a position in which the first and second bodies of the rocker arm are unlatched).

The actuation lever 312 comprises a central portion 312*c* comprising two wings 319 extending from a main portion 313 of the actuation lever 312, where each wing 319 defines an aperture 319*a* through which the shaft 310 is received. The biasing means 314 is arranged to urge or preload the actuation lever 312 from the second position towards the first position.

A first end of the biasing means 314 contacts a reaction member 350 fixed relative to the shaft 310 (it is noted that two reaction members 350 attached to the shaft 310 are shown in FIG. 3, one for each actuation lever 312, but only one is described for brevity, as they are operated similarly and in common). The reaction member 350 extends radially from the shaft 310, i.e. extends perpendicularly to the axis E. The reaction member 350 is fixedly mounted on the shaft 310 between the two wings 319 of the actuation lever 312. A second end of the biasing means contacts the actuation lever 312 at a first end portion 312*a* of the actuation lever 312. A second end portion 312*b* of the actuation lever 312, located on an opposite side of the central portion 312*c* to the first end portion 312*a* of the actuation lever 312, is arranged for contacting the latching arrangement (i.e. for contacting the latch pin 80) of the rocker arm.

The actuation apparatus 300 comprises an actuation source, for example an electrical motor or hydraulic motor or other suitable means, arranged to rotate the further shaft 310. The actuation source may be controlled by a control unit.

When actuation of the latching arrangement is required (for example when a mode of operation of the rocker arm is required to be changed) the actuation source may rotate the shaft 310 (see arrow R2 of FIG. 3) to cause the reaction member 350 to apply a force to the biasing means 314 towards the first end portion 312*a* of the actuation lever 312, which in turn may causes the actuation lever 312 to exert a force onto the latching arrangement.

In cases where the latching arrangement is actuatable (i.e. the latch pin 80 is free to be moved from the unlatched position to the latched position), this force may cause the actuation lever 312 to pivot from the second position to the first position, which may in turn case actuation of the latching arrangement (i.e. may cause the latch pin 80 to move from the unlatched position to the latched position). Hence the mode of operation of the rocker arm may be changed, substantially immediately.

However, in some cases, as described above, the latching arrangement may not be actuatable (i.e. non-actuatable). In these cases, when the actuation source attempts to actuate the latching arrangement by rotating the shaft 310 to cause the reaction member 350 to apply a force to the biasing means 314 towards the first end portion 312*a* of the actuation lever 312, this force causes the biasing means 314 to become biased (compressed, energised). The biasing means 314 then causes the actuation lever 312 to pivot from the second position to the first position, thereby to actuate the latching arrangement, when (i.e. as soon as) the component becomes actuatable again.

In other words, the biasing means 314 is biased when the actuation source attempts to cause the actuation lever 312 to be in the first position (i.e. when the reaction member 350 compresses the biasing means 314 when the actuation source rotates the shaft 310 in order to attempt to actuate the latching arrangement) when the latching arrangement is non-actuatable, such that the biasing means 314 causes the actuation lever 312 to pivot from the second position to the first position thereby to actuate the latching arrangement when the component becomes actuatable again.

As a result, the latch pin 80 is moved from the unlatched position to the latched position, hence latching the inner body and the outer body together, hence switching the mode of operation of the rocker arm.

As a result, regardless of the blocked or unblocked state of the latch pin 80 (i.e. regardless of whether the latching arrangement is actuatable or non-actuatable), the latching arrangement may be actuated by the actuation apparatus 300 as soon as it is physically possible to do so. This may be referred to as a compliance function of the actuation apparatus 300. This reduces the need to control the timing of the actuation to be synchronised with the engine cycle, and hence may provide for simpler and more efficient control.

At a later stage, for example when de-actuation of the latching arrangement is required, the actuation source may rotate the shaft 310 in an opposite direction (i.e. opposite to the direction illustrated by the arrow R2 in FIG. 3) so that the reaction member 350 rotates away from the first end portion 312*a* of the actuation lever 312. As a result, the second end 312*b* of the actuation lever 312 may no longer exert a substantial force to the latch pin 80. As a result, the latch pin 80 may move from the latched position to the unlatched position under the force of the biasing element, hence the latch pin 80 no longer latches the inner body and the outer body together, and hence the operation mode of the rocker arm is switched back again.

Having a compliance functionality provided by the biasing means 314 acting on the actuation lever 312 may provide for improved packaging for example as compared to providing the compliance functionality in the actuation arrangements of the rocker arms themselves. For example, not having to provide compliance functionality in the rocker arms themselves allows for the packaging footprint of the rocker arms to be reduced.

Having a biasing means 314 that is a spring 314, for example a compression 314, may allow for the compliance functionality to be provided without using a torsional spring, which may be advantageous in some cases.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE SIGNS LIST

A, B, C, D, E axis
R1, R2 actuation rotation
1, 2, 3 valve train assembly
53 contact surface
80 latch pin
100, 200, 300 actuation apparatus
110, 210, 310 shaft
110*a*, 210*a* first portion
110*b*, 210*b* second portion
111, 211, 311 support
112, 212, 312 actuation lever
112*a*, 212*a*, 312*a* first end portion
112*b*, 212*b*, 312*b* second end portion
112*c*, 212*c*, 312*c* central portion
113, 213, 313 main length
114, 214, 314 biasing means
119, 219, 319 wings

119*a*, 219*a*, 319*a* apertures
150, 250, 350 reaction member
260 further shaft
262 lobed cam
262*a* lobed profile
262*b* base circle

The invention claimed is:

1. An actuation apparatus for actuating a component of a switchable valve train device of an internal combustion engine, the actuation apparatus comprising:

a shaft;

an actuation lever mounted on the shaft for pivotal motion of the actuation lever between a first position for actuation of the component and a second position for de-actuation of the component, the actuation lever comprising a first end portion, a central portion, and a second end portion; and a biasing means configured to urge the actuation lever from the second position towards the first position, wherein the apparatus is arranged and configured such that, in use, the biasing means is biased when an actuation source moves the actuation lever towards the first position when the component is non-actuatable, such that the biasing means causes the actuation lever to pivot from the second position to the first position, thereby to actuate the component when the component becomes actuatable again, and the biasing means contacts the actuation lever at the first end portion, thereby to urge pivotal movement of the actuation lever towards the first position.

2. The actuation apparatus according to claim 1, wherein the actuation lever is pivotally mounted to the shaft at or towards the central portion of the actuation lever.

3. The actuation apparatus according to claim 2, wherein a second end portion of the actuation lever, on an opposite side of the central portion to the first end portion of the actuation lever, is configured to contact the component.

4. The actuation apparatus according to claim 1, further comprising a reaction member fixed relative to the shaft and against which the biasing means is configured to react so that the biasing means urges the actuation lever towards the first position.

5. The actuation apparatus according to claim 1, wherein the shaft comprises a first portion defining a first axis and a second portion defining a second axis, the second axis being substantially parallel with and radially offset from the first axis, and wherein the actuation lever is mounted to the second portion of the shaft.

6. The actuation apparatus according to claim 5, wherein the first portion of the shaft is rotatable about the first axis by the actuation source to cause the second portion of the shaft to move along an arc, and wherein the actuation apparatus is configured such that, in use, the biasing means becomes biased when the actuation source rotates the first portion of the shaft in order to attempt to actuate the component when the component is non-actuatable, such that the biasing means causes the actuation lever to pivot from the second position to the first position thereby to actuate the component when the component becomes actuatable again.

7. The actuation apparatus according to claim 5, further comprising a further shaft having a lobed cam mounted thereon, wherein the further shaft is rotatable by the action source, and wherein the actuation apparatus is configured such that, in use, the biasing means becomes biased when the actuation source rotates the further shaft so that a lobed profile of the lobed cam contacts the actuation lever thereby to cause the actuation lever to pivot from the first position to the second position.

8. The actuation apparatus according to claim 7, wherein the actuation apparatus is configured such that, in use, when the actuation source rotates the further shaft so that a base circle of the lobed cam contacts or is orientated towards the actuation lever, and when the component is or becomes actuatable, the biasing means causes the actuation lever to pivot from the second position to the first position, thereby to actuate the component.

9. The actuation apparatus according to claim 1, further comprising a reaction member, wherein the reaction member extends radially from the shaft, wherein the actuation apparatus is configured such that, in use, the biasing means becomes biased when the reaction member compresses the biasing means when the actuation source rotates the shaft such that the biasing means causes the actuation lever to pivot from the second position to the first position, thereby to actuate the component, when the component becomes actuatable again.

10. The actuation apparatus according to claim 7, further comprising a support configured to support the shaft, the support being configured to fix to a portion of the internal combustion engine.

11. The actuation apparatus according to claim 10, wherein the shaft is fixed relative to the support.

12. A valve train assembly, comprising: the actuation apparatus according to claim 1; and the switchable valve train device.

13. The valve train assembly according to claim 12, wherein the switchable valve train device is a switchable rocker arm comprising a first body and a second body, and the component of the switchable rocker arm is a latching arrangement comprising a moveable latch pin for latching the first body and the second body together.

14. The valve train assembly according to claim 13, wherein the valve train assembly is configured such that, in use, when the actuation lever is moved from the second position to the first position, the actuation lever actuates the latching arrangement of the rocker arm so as to move the latch pin from an unlatched position in which the first body and the second body are unlatched so that the first body and the second body are moveable relative to one another so that the switchable rocker arm is configured for a second mode of operation, to a latched position in which the first body and the second body are latched together so that the switchable rocker arm is configured for a first mode of operation.

15. The valve train assembly according to claim 14, wherein the latching arrangement further comprises a biasing element configured to urge the latch pin from the latched position to the unlatched position.

16. An actuation apparatus for actuating a component of a switchable valve train device of an internal combustion engine, the actuation apparatus comprising:

a shaft;

an actuation lever mounted on the shaft for pivotal motion of the actuation lever between a first position for actuation of the component and a second position for de-actuation of the component;

a biasing means configured to urge the actuation lever from the second position towards the first position; and a reaction member fixed relative to the shaft and against which the biasing means is configured to react so that the biasing means urges the actuation lever towards the first position, wherein the apparatus is configured such that, in use, the biasing means is biased when an actuation source moves the actuation lever towards the first position when the component is non-actuatable, such that the biasing means causes the actuation lever to pivot from the second position to the first position, thereby to actuate the component when the component becomes actuatable again.

17. An actuation apparatus for actuating a component of a switchable valve train device of an internal combustion engine, the actuation apparatus comprising:

a shaft comprising a first portion defining a first axis and a second portion defining a second axis, the second axis being substantially parallel with and radially offset from the first axis;

an actuation lever mounted on the shaft for pivotal motion of the actuation lever between a first position for actuation of the component and a second position for de-actuation of the component, wherein the actuation lever is mounted to the second portion of the shaft; and a biasing means configured to urge the actuation lever from the second position towards the first position, wherein the apparatus is configured such that, in use, the biasing means is biased when an actuation source moves the actuation lever towards the first position when the component is non-actuatable, such that the biasing means causes the actuation lever to pivot from the second position to the first position, thereby to actuate the component when the component becomes actuatable again.

* * * * *